US005908472A

United States Patent [19]

Vollmond

[11] Patent Number: 5,908,472

[45] Date of Patent: Jun. 1, 1999

[54] FABRIC TREATED WITH CELLULASE AND OXIDOREDUCTASE

[75] Inventor: Thomas Vollmond, Soborg, Denmark

[73] Assignee: Novo Nordisk A/S, Bagsvaerd, Denmark

[21] Appl. No.: 09/079,027

[22] Filed: May 14, 1998

Related U.S. Application Data

[63] Continuation of application No. PCT/DK97/00002, Jan. 8, 1997.

[30] Foreign Application Priority Data

Jan. 12, 1996 [DK] Denmark ..... 0024/96

[51] Int. Cl.[6] ..... D06M 16/00; D06P 5/02

[52] U.S. Cl. ..... 8/102; 8/138; 8/107; 8/111; 8/401; 435/263

[58] Field of Search ..... 8/102, 138, 107, 8/111, 401; 435/263

[56] References Cited

U.S. PATENT DOCUMENTS

| | | | |
|---|---|---|---|
| 4,832,864 | 5/1989 | Olson | 8/102 |
| 5,565,006 | 10/1996 | Videbaek et al. | 8/102 |
| 5,650,322 | 7/1997 | Clarkson et al. | 435/263 |
| 5,752,980 | 5/1998 | Pedersen et al. | 8/102 |

FOREIGN PATENT DOCUMENTS

| | | |
|---|---|---|
| WO 92/18683 | 10/1992 | WIPO . |
| WO 94/12619 | 6/1994 | WIPO . |
| WO 96/12846 | 5/1996 | WIPO . |

*Primary Examiner*—Alan Diamond
*Attorney, Agent, or Firm*—Steve T. Zelson, Esq.; Reza Green, Esq.; Carol E. Rozek, Esq.

[57] ABSTRACT

The present invention relates to a process for providing an abraded look with a reduced strength loss in dyed fabric comprising (a) contacting, in an aqueous medium, a dyed fabric with a cellulase in a concentration corresponding to 0.01–250 μg of enzyme protein per g of fabric; and (b) simultaneously or subsequently treating the fabric with a phenol oxidizing enzyme and an enhancing agent.

24 Claims, No Drawings

FABRIC TREATED WITH CELLULASE AND OXIDOREDUCTASE

CROSS-REFERENCE TO RELATED APPLICATIONS

This application is a continuation application of PCT/DK97/00002 filed Jan. 8, 1997 and claims priority under 35 U.S.C. 119 of Danish application 0024/96 filed Jan. 12, 1996, the contents of which are fully incorporated herein by reference.

FIELD OF INVENTION

The present invention relates to a process for providing a worn look in dyed fabric, especially cellulosic fabric such as denim.

BACKGROUND ART

The past several years have seen the emergence of a new industry, the so called "jeans stonewashing" segment, generated by the fashion demands of a generation desirous of stylish, but informal and comfortable clothing.

Originally, all of the indigo jeans on the market were stiff and uncomfortable when first purchased, due to the finishing system used for denim fabrics.

The first step in the processing evolution was to sell jeans that had been laundered by the manufacturer. These "pre-washed" jeans had a slightly faded appearance and a softer hand that felt comfortable, as though they had been laundered several times. This trend became fashionable as well, and consumers were willing to pay the extra cost involved for this additional processing.

Not long after the introduction of pre-washed jeans, the idea of using abrasive stones to accelerate the aging process was developed, and "stone washing" became the second step in the evolution. Volcanic stones were included in the wash, or tumbled with the damp garments to wear down the stiffest portions such as belt areas, cuffs, and pockets.

However, the use of stones to abrade jeans is very destructive to equipment and fabric, so today the stones are often substituted with a cellulase treatment, or a combination of stones and cellulase is used to achieve the abraded (worn) look; for reference see "AATCC: Garment Wet Processing Technical Manual", 1994, published by American Association of Textile Chemists and Colorists, pp. 19–21.

The fabric looses strength by using the stone-process described above, and the stone-free cellulase treatment does not alone give the desired worn look, so there is a need in industry for a more gentle process.

SUMMARY OF THE INVENTION

Surprisingly it has been found that by combining the cellulase treatment with a treatment with a phenol oxidizing enzyme system and an enhancing agent it is possible to achieve the desired worn look in fabric with a minimal strength loss; accordingly the present invention relates to a process for providing an abraded look with a reduced strength loss in dyed fabric comprising (a) contacting, in an aqueous medium, a dyed fabric with a cellulase in a concentration corresponding to 0.01–250 $\mu$g of enzyme protein per g of fabric;

(b) simultaneously or subsequently treating said fabric with a phenol oxidizing enzyme system and an enhancing agent, wherein the enhancing agent can be described by formula I:

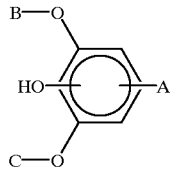

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$; or by formula II:

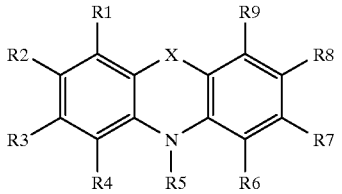

in which formula X represents (—O—) or (—S—), and the substituent groups $R^1$–$R^9$, which may be identical or different, independently represents any of the following radicals: hydrogen, halogen, hydroxy, formyl, carboxy, and esters and salts hereof, carbamoyl, sulfo, and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$;

which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^9$ may together form a group —B—, in which B represents any of the following the groups: $(—CHR^{10}—N=N—)$, $(—CH=CH—)_n$, $(—CH=N—)_n$ or $(—N=CR^{10}—NR^{11}—)$, in which groups n represents an integer of from 1 to 3, $R^{10}$ is a substituent group as defined above and $R^{11}$ is defined as $R^{10}$.

DETAILED DESCRIPTION OF THE INVENTION

Bleached Versus Worn Look

Persons skilled in the art of evaluating denim finishing processes, are capable of differentiating between a bleached look and a worn (or abraded) look of denim.

The former is a result of removal (bleaching) of dye from the dyed warp yarn. Since the bleaching takes place on the whole surface of every dyed yarn, the result is a general reduction in colour intensity. Thus, the bleached look of a pair of indigo-dyed jeans is characterised by a lighter blue shade than the corresponding reference.

The latter—the worn look—is a result of a treatment of denim with cellulase and/or pumice stone. This process is characterised by an uneven removal of dye from the fabric, hence it results in a high level of contrast between dyed areas and areas from which dye has been removed.

Typically the worn look is obtained by a process involving cellulase and/or pumice stone, whereas the bleached look can be obtained by a process involving non-enzymatic bleaching agents such as hypochlorite or by a process involving oxidoreductase and an enhancing agent.

The present invention relates to a process of providing a worn but not bleached look, comprising a mild treatment with a cellulase and a subsequent mild treatment with an oxidoreductase and an enhancing agent.

Dyed Fabric

The invention may be applied to any dyed fabric known in the art, in particular to synthetic fabrics such as polyester or to natural fabrics.

The invention is most beneficially applied to cellulose-containing fabrics, such as cotton, viscose, rayon, ramie, linen, Tencel, or mixtures thereof, or mixtures of any of these fibres, or mixtures of any of these fibres together with synthetic fibres. In particular, the fabric is denim.

The fabric may be dyed with vat dyes such as indigo, or indigo-related dyes such as thioindigo. The fabric may also be dyed with more than one dye, e.g., first with a sulphur dye and then with an indigo dye, or vice versa.

In a most preferred embodiment of the invention, the fabric is an indigo-dyed denim with a sulphur-bottom, (i.e. the denim is first dyed with a sulphur dye and then with an indigo dye); including clothing items manufactured therefrom.

Cellulases

In the present context, the term "cellulose" refers to an enzyme which catalyses the degradation of cellulose to glucose, cellobiose, triose and other cello-oligosaccharides.

In the present context the term "cellulase" is understood to include a mature protein or a precursor form thereof or a functional fragment thereof which essentially has the activity of the full-length enzyme. Furthermore, the term "cellulase" is intended to include homologues or analogues of said enzyme. Such homologues comprise an amino acid sequence exhibiting a degree of identity of at least 60% with the amino acid sequence of the parent enzyme, i.e. the parent cellulase. The degree of identity may be determined by conventional methods, see for instance, Altshul et al., *Bull. Math. Bio.* 48, 1986, pp. 603–616, and Henikoff and Henikoff, *Proc. Natl. Acad. Sci. USA* 89, 1992, pp. 10915–10919.

Preferably, the cellulase to be used in the present invention is a monocomponent (recombinant) cellulase, i.e. a cellulase essentially free from other proteins or cellulase proteins. A recombinant cellulase component may be cloned and expressed according to standard techniques conventional to the skilled person.

In a preferred embodiment of the invention, the cellulose to be used in the method is an endoglucanase (EC 3.2.1.4), preferably a monocomponent (recombinant) endoglucanase.

Preferably, the cellulase is a microbial cellulase, more preferably a bacterial or fungal cellulase.

Examples of bacterial cellulases are cellulases derived from or producible by bacteria from the group of genera consisting of Pseudomonas or Bacillus, in particular *Bacillus lautus.*

The cellulase or endoglucanase may be an acid, a neutral or an alkaline cellulase or endoglucanase, i.e. exhibiting maximum cellulolytic activity in the acid, neutral or alkaline range, respectively.

Accordingly, a useful cellulase is an acid cellulase, preferably a fungal acid cellulase, which is derived from or producible by fungi from the group of genera consisting of Trichoderma, Actinomyces, Myrothecium, Aspergillus, and Botrytis.

A preferred useful acid cellulase is derived from or producible by fungi from the group of species consisting of *Trichoderma viride, Trichoderma reesei, Trichoderma longibrachiatum, Myrothecium verrucaria, Aspergillus niger, Aspergillus oryzae*, and *Botrytis cinerea.*

Another useful cellulase or endoglucanase is a neutral or alkaline cellulase, preferably a fungal neutral or alkaline cellulose, which is derived from or producible by fungi from the group of genera consisting of Aspergillus, Penicillium, Myceliophthora, Humicola, Irpex, Fusarium, Stachybotrys, Scopulariopsis, Chaetomium, Mycogone, Verticillium, Myrothecium, Papulospora, Gliocladium, Cephalosporium and Acremonium.

A preferred alkaline cellulase is derived from or producible by fungi from the group of species consisting of *Humicola insolens, Fusarium oxysporum, Myceliopthora thermophila*, or *Cephalosporium sp.*, preferably from the group of species consisting of *Humicola insolens*, DSM 1800, *Fusarium oxysporum*, DSM 2672, *Myceliopthora thermophila*, CBS 117.65, or *Cephalosporium sp.*, RYM-202.

A preferred example of a native or parent cellulase is an alkaline endoglucanase which is immunologically reactive with an antibody raised against a highly purified ~43 kD endoglucanase derived from *Humicola insolens*, DSM 1800, or which is a derivative of the ~43 kD endoglucanase exhibiting cellulase activity.

Other examples of useful cellulases are variants having, as a parent cellulase, a cellulase of fungal origin, e.g. a cellulase derivable from a strain of the fungal genus Humicola, Trichoderma or Fusarium.

According to the invention the concentration of the cellulase enzyme in the aqueous medium may be 0.01–250 μg of enzyme protein per g of fabric, preferably 0.1–250 μg of enzyme protein per g of fabric, in particular 0.5–50 μg of enzyme protein per g of fabric.

Determination of Cellulase Activity (ECU)

In the context of this invention, cellulase activity can be expressed in ECU. Cellulolytic enzymes hydrolyse CMC, thereby increasing the viscosity of the incubation mixture. The resulting reduction in viscosity may be determined by a vibration viscosimeter (e.g. MIVI 3000 from Sofraser, France).

Determination of the cellulolytic activity, measured in terms of ECU, may be determined according to the following analysis method (assay): The ECU assay quantifies the amount of catalytic activity present in the sample by measuring the ability of the sample to reduce the viscosity of a solution of carboxy-methylcellulose (CMC). The assay is carried out at 40° C.; pH 7.5; 0.1M phosphate buffer; time 30 min; using a relative enzyme standard for reducing the viscosity of the CMC (carboxymethylcellulose Hercules 7 LFD) substrate; enzyme concentration approx. 0.15 ECU/ml. The arch standard is defined to 8200 ECU/g.

Phenol Oxidizing Enzyme Systems

By the term "a phenol oxidizing enzyme system" is meant a system in which an enzyme, by using hydrogen peroxide or molecular oxygen, is capable of oxidizing organic compounds containing phenolic groups. Examples of such enzymes are peroxidases and oxidases.

If the phenol oxidizing enzyme system requires a source of hydrogen peroxide, the source may be hydrogen peroxide or a hydrogen peroxide precursor for in situ production of hydrogen peroxide, e.g., percarbonate or perborate, or a hydrogen peroxide generating enzyme system, e.g., an oxidase and a substrate for the oxidase, or an amino acid oxidase and a suitable amino acid, or a peroxycarboxylic acid or a salt thereof. Hydrogen peroxide may be added at the beginning of or during the process, e.g., in a concentration corresponding to 0.001–25 mM $H_2O_2$.

If the phenol oxidizing enzyme system requires molecular oxygen, molecular oxygen from the atmosphere will usually be present in sufficient quantity.

The enzyme of the phenol oxidizing enzyme system may be an enzyme exhibiting peroxidase activity or a laccase or a laccase related enzyme as described below.

According to the invention the concentration of the phenol oxidizing enzyme in the aqueous medium may be 0.01–250 μg of enzyme protein per g of fabric, preferably 0.1–250 μg of enzyme protein per g of fabric, in particular 0.5–50 μg of enzyme protein per g of fabric.

Peroxidases and Peroxidase Acting Compounds

An enzyme exhibiting peroxidase activity may be any peroxidase enzyme comprised by the enzyme classification (EC 1.11.1.7), or any fragment derived therefrom, exhibiting peroxidase activity, or synthetic or semisynthetic derivatives thereof (e.g. porphyrin ring systems or microperoxidases, cf. e.g. U.S. Pat. No. 4,077,768, EP 537 381, WO 91/05858 and WO 92/16634). Such enzymes are known from microbial, plant and animal origins.

Preferably, the peroxidase employed in the method of the invention is producible by plants (e.g. horse radish or soybean peroxidase) or microorganisms such as fungi or bacteria. Some preferred fungi include strains belonging to the subdivision Deuteromycotina, class Hyphomycetes, e.g., Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or Trametes (previously called Polyporus), e.g. *T. versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g., *Streptomyces spheroides* (ATTC 23965), *Streptomyces thermoviolaceus* (IFO 12382) or *Streptoverticillum verticillium* ssp. *verticillium.*

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g., *M. virescens.*

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a recombinantly produced peroxidase is a peroxidase derived from a *Coprinus sp.*, in particular *C. macrorhizus* or *C. cinereus* according to WO 92/16634, or a variant thereof, e.g., a variant as described in WO 94/12621.

In the context of this invention, peroxidase acting compounds comprise peroxidase active fragments derived from cytochromes, haemoglobin or peroxidase enzymes, and synthetic or semisynthetic derivatives thereof, e.g. iron porphins, iron porphyrins, and iron phthalocyanine and derivatives thereof.

Determination of Peroxidase Activity 1 peroxidase unit (PODU) is the amount of enzyme that catalyzes the conversion of 1 μmole hydrogen peroxide per minute at the following analytical conditions: 0.88 mM hydrogen peroxide, 1.67 mM 2,2'-azinobis (3-ethylbenzothiazoline-6-sulfonate), 0.1 M phosphate buffer, pH 7.0, incubated at 30° C., photometrically followed at 418 nm.

Laccase and Laccase Related Enzymes

In the context of this invention, laccases and laccase related enzymes contemplate any laccase enzyme comprised by the enzyme classification (EC 1.10.3.2), any chatechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1).

The laccase enzymes are known from microbial and plant origin. The microbial laccase enzyme may be derived from bacteria or fungi (including filamentous fungi and yeasts) and suitable examples include a laccase derivable from a strain of Aspergillus, Neurospora, e.g., *N. crassa*, Podospora, Botrytis, Collybia, Fomes, Lentinus, Pleurotus, Trametes, e.g., *T. villosa* and *T. versicolor*, Rhizoctonia, e.g., *R. solani*, Coprinus, e.g. *C. plicatilis* and *C. cinereus*, Psatyrella, Myceliophthora, e.g. *M. thermophila*, Schytalidium, Polyporus, e.g., *P. pinsitus*, Phlebia, e.g., *P. radita* (WO 92/01046), or Coriolus, e.g., *C. hirsutus* (JP 2-238885).

The laccase or the laccase related enzyme may furthermore be one which is producible by a method comprising cultivating a host cell transformed with a recombinant DNA vector which carries a DNA sequence encoding said laccase as well as DNA sequences encoding functions permitting the expression of the DNA sequence encoding the laccase, in a culture medium under conditions permitting the expression of the laccase enzyme, and recovering the laccase from the culture.

Determination of Laccase Activity (LACU)

Laccase activity is determined from the oxidation of syringaldazin under aerobic conditions. The violet colour produced is photometered at 530 nm. The analytical conditions are 19 $\mu$M syringaldazin, 23.2 mM acetate buffer, pH 5.5, 30° C., 1 min. reaction time.

1 laccase unit (LACU) is the amount of enzyme that catalyses the conversion of 1.0 $\mu$mole syringaldazin per minute at these conditions.

Enhancing Agents

According to the present invention an enhancing agent is any compound that enhances the bleaching process. The enhancing agent will typically be an organic compound, e.g., an organic compound described by one of the following formulas:

The enhancing agent may be described by the following formula I:

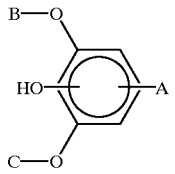

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In a preferred embodiment A in the above mentioned formula is —CO—E, in which E may be —H, —OH, —R, or —OR; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In the above mentioned formula A may be placed meta to the hydroxy group instead of being placed in the paraposition as shown.

In particular embodiments, the enhancing agent is acetosyringone, methylsyringate, ethylsyringate, propylsyringate, butylsyringate, hexylsyringate, or octylsyringate.

The enhancing agents described above may be prepared using methods well known to those skilled in the art; some of the enhancing agents are also commercially available, e.g., acetosyringone. Methylsyringate, ethylsyringate, propylsyringate, butylsyringate, hexylsyringate and octylsyringate may be produced as disclosed in *Chem. Ber.* 67, 1934, p. 67.

The enhancing agent used in the present invention may also be described by the following formula II:

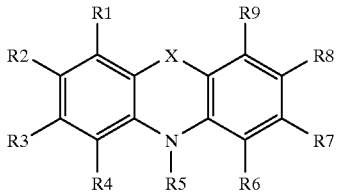

in which formula X represents (—O—) or (—S—), and the substituent groups $R^1$–$R^9$, which may be identical or different, independently represents any of the following radicals: hydrogen, halogen, hydroxy, formyl, carboxy, and esters and salts hereof, carbamoyl, sulfo, and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and- may furthermore be unsubstituted or substituted with one or more substituent groups $R^{10}$;

which substituent group $R^{10}$ represents any of the. following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^9$ may together form a group —B—, in which B represents any of the following the groups: $(—CHR^{10}—N=N—)$, $(—CH=CH—)_n$, $(—CH=N—)_n$ or $(—N=CR^{10}—NR^{11}—)$, in which groups n represents an integer of from 1 to 3, $R^{10}$ is a substituent group as defined above and $R^{11}$ is defined as $R^{10}$.

In particular embodiments, the enhancing agent is 10-methylphenothiazine, phenothiazine-10-propionic acid, N-hydroxysuccinimide phenothiazine-10-propionate, 10-ethylphenothiazine-4-carboxylic acid, 10-ethylphenothiazine, 10-propylphenothiazine, 10-isopropylphenothiazine, methyl phenothiazine-10-propionate, 10-phenylphenothiazine, 10-allylphenothiazine, 10-(3-(4-methylpiperazin-1-yl)propyl)phenothiazine, 10-(2-pyrrolidin-1-yl-ethyl)phenothiazine, 2-methoxy-10-methylphenothiazine, 1-methoxy-10-methylphenothiazine, 3-methoxy-10-methylphenothiazine, 3,10-dimethylphenothiazine, 3,7,10-trimethyiphenothiazine, 10-(2-hydroxyethyl)phenothiazine, 10-(3-hydroxypropyl) phenothiazine, 3- (2-hydroxyethyl) -10-methylphenothiazine, 3-hydroxymethyl-10-methylphenothiazine, 3,7-dibromophenothiazine-10-propionic acid, phenothiazine-10-propionamide, chlorpromazine, 2-chloro-10-methylphenothiazine, 2-acetyl-10-methylphenothiazine, 10-methylphenoxazine, 10-ethylphenoxazine, phenoxazine-10-propionic acid, 10-(2-hydroxyethyl)phenoxazine or 4-carboxyphenoxazine-10-propionic acid.

The enhancing agents may be obtained from Sigma-Aldrich, Janssen Chimica, Kodak, Tokyo Kasai Organic Chemicals, Daiichi Pure Chemicals Co. or Boehringer Mannheim; N-methylated derivatives of phenothiazine and phenoxazine may be prepared by methylation with methyliodide as described by Cornel Bodea and Ioan Silberg in "Recent Advances in the Chemistry of Phenothiazines" (Advances in heterocyclic chemistry, 1968, Vol. 9, pp. 321–460); B. Cardillo & G. Casnati in Tetrahedron, 1967, Vol. 23, p. 3771. Phenothiazine and phenoxazine propionic acids may be prepared as described in *J. Org. Chem.* 15, 1950, pp. 1125–1130. Hydroxyethyl and hydroxypropyl derivatives of phenothiazine and phenoxazine may be prepared as described by G. Cauquil in *Bulletin de la Society Chemique de France*, 1960, p.1049.

The enhancing agent of the invention may be present in concentrations of from 0.05 to 500 μmole per g denim, preferably 0.05 to 100 μmole per g denim, in particular 0.05 to 20 μmole per g denim.

Industrial Applications

The present invention is typically used in industrial machines for cellulase treatment of fabric.

The fabric is normally added to the machine according to the machine capacity per the manufacturer's instructions. The fabric may be added to the machine prior to introducing water or the fabric may be added after water is introduced.

Normally, the cellulase treatment will be performed first, followed by the treatment with the phenol oxidizing enzyme system and the enhancing agent, but the two processes may be performed simultaneously, or vice versa.

The cellulase may be present in the water prior to adding the fabric or it may be added after the fabric has been wetted. Normally a buffer will be used in order to be close to the pH optimum of the enzyme in question. After the fabric has been contacted with the cellulase it should be agitated in the machine for a sufficient period of time to ensure that the fabric is fully wetted and to ensure the action of the enzyme. Typically a reaction time between 5 and 60 minutes and a reaction temperature between 20° C. and 90° C., preferably between 30° C. and 80° C., more preferably between 40° C. and 70° C., will be suitable.

The phenol oxidizing enzyme system and the enhancing agent of the invention may be present in the water prior to adding the fabric or they may be added after the fabric has been wetted. The phenol oxidizing enzyme system may be added simultaneously with the enhancing agent or they may be added separately. Normally a buffer will be used in order to be close to the pH optimum of the enzyme in question. After the fabric has been contacted with the phenol oxidizing enzyme system and the enhancing agent of the invention it should be agitated in the machine for a sufficient period of time to ensure that the fabric is fully wetted and to ensure the action of the enzyme system and the enhancing agent. Typically a reaction time between 5 and 60 minutes and a reaction temperature between 20° C. and 90° C., preferably between 30° C. and 80° C., more preferably between 40° C. and 70° C., will be suitable.

The above described process steps may be performed once or it may be repeated two or three times depending on how worn the dyed fabric should look.

The invention is further illustrated in the following examples which are not intended to be in any way limiting to the scope of the invention as claimed.

EXAMPLE 1

Treatment of Denim with Cellulase and Laccase/Enhancing Agent

Treatment of denim was carried out in industrial scale equipment (450 litres) using 50 kg of denim.

5 different types of denim (all manufactured by Levi Strauss & Co) were applied. The 5 types of denim were all of the "sulphur-bottom" type but the ratio between indigo and sulphur dye varied, as did the fabric construction.

Step 1: Abrasion with cellulase/pumice stone.

The denim was split into 2 different abrasion processes:

1) a standard abrasion process involving neutral cellulase+ pumice stone or
2) an abrasion process with no addition of pumice stone.
   1: 750 g MTF12EB (neutral cellulase, available from T. S. Chemicals, UK) 64 kg pumice stone 50 minutes, pH 6.5, 60° C. per 50 kg of denim
   2: 750 g MTF12EB (neutral cellulase, available from T. S. Chemicals, UK) 50 minutes, pH 6.5, 60° C. per 50 kg of denim Step 2: Treatment with laccase and enhancing agent The jeans from step 1 (except one of each type, which were kept as reference) were then treated with a laccase and an enhancing agent using following dosages and conditions:

270 g mono-sodium phosphate 68 g di-sodium phosphate 40.5 g PPT (10-propionic acid phenothiazine)

40000 LACU (=625 mg) *Trametes villosa* laccase, available from Novo Nordisk A/S 12 minutes, pH 6–6.5, 60° C. per 50 kg of denim As a result of the treatments, each type of denim resulted in 4 different looks (+/− pumice stone in cellulase treatment and +/− laccase treatment).

The jeans were then subjected to visual evaluation by 6 experts, skilled in the art of evaluating denim finishing processes. The major conclusions from their evaluation were:

The cellulase process without pumice stone resulted in significantly less abrasion than the corresponding process involving pumice stone.

The process consisting of a cellulase treatment step without pumice stone and a subsequent treatment with laccase and enhancing agent resulted in jeans with a highly worn look without having a bleached look. This was evaluated as extremely interesting as the process provides a look that would otherwise require higher amounts of cellulase and addition of substantial amounts of pumice stone. Furthermore, the process provided a highly worn look, without having the fabric damage that would be the result of a pumice stone or cellulase/pumice stone process for obtaining the same look.

EXAMPLE 2

Abrasion Enhancement with *Myceliophthora thermophila* Laccase and Methyl Syringate as Enhancing Agent Fabric:

Swift denim fabric (type Dakota) was used.

Abrasion:

A 12 kg Wascator FL 120 wash extractor was used for abrasion of the denim.

Denim load: 2.6 kg

Water: 40 l

Buffer: 30 g $KH_2PO_4$ 10 g $Na_2HPO_4$ pH: 6.8

Enzyme: 70 g Denimax™ T (a commercial product, available from Novo Nordisk A/S, Bagsvaerd, Denmark)

Time: 2 hours

Temperature: 55° C.

Abrasion enhancement:

A Wascator FOM 71 wash extractor was used for abrasion enhancement of the denim.

Denim load: 0.8 kg

Water: 20 l

Buffer: 4.2 g Sodium acetate, 3 $H_2O$ 4.0 g Succinic acid pH: 5.1

Enzyme: 670 LACU *Myceliophthora thermophila* laccase (available from Novo Nordisk A/S)

Enhancing agent 0.5 g Methyl syringate

Time: 20 minutes

Temperature: 60° C.

Evaluation:

The results were evaluated visually in a lightbox as well as by measuring the reflection. For the latter a Texflash 2000 (available from Datacolor) was used to evaluate the degree of bleaching and brightening using the change in the color space coordinates L*a*b*: L gives the change in black (−L*)/white (+L*), a gives the change in green (−a*)/red (+a*), and b gives the change in blue (−b*)/yellow (+b*).

A decrease in L* means an increase in blackness (decrease of white colour), an increase in L* means an increase in whiteness (a decrease in black colour), a decrease in a* means an increase in green colour (decrease in red colour), an increase in a* means an increase in red colour (a decrease in green colour), a decrease in b* means an increase in blue colour (a decrease in yellow colour), and an increase in b* means an increase in yellow colour (a decrease in blue colour).

The Texflash 2000 was operated in the L*a*b* coordinate system. The light source used was a CIE light standard C. Each measurement was an average of 10 measurements. The instrument was calibrated using calibration plates (black and white).

Results:

The results are shown in the following table (Table 1):

TABLE 1

| Process step | L* | a* | b* | ΔL* |
|---|---|---|---|---|
| Abraded | 31.60 | −1.45 | −17.41 | |
| Abraded and enhanced | 34.88 | −1.69 | −16.64 | 3.28 |

From visual evaluation the abrasion enhancement process produced denim with a highly worn look without having a bleached look, similar to the results obtained in Example 1. Thus, the *Myceliophthora thermophila* laccase and the methyl syringate enhancing agent work in a similar manner as the laccase and enhancing agent used in Example 1.

EXAMPLE 3

Abrasion Enhancement with Varying Levels of Cellulase Abrasion and Varying Dosages of Laccase and Enhancing Agent Fabric:

Swift denim fabric (type Dakota) was used.

Abrasion:

A 12 kg Wascator FL 120 wash extractor was used for abrasion of the denim. 3 different dosages of cellulase were used applied.

Denim load: 2.6 kg

Water: 40 l

Buffer: 30 g $KH_2PO_4$ 10 g $Na_2HPO_4$ pH: 6.8

Enzyme: Denimax™ Ultra MG (a commercial monocomponent cellulase product, available from Novo Nordisk A/S)

1: 8 g (=3.7 μg cellulase/g fabric)

2: 28 g (=12.9 μg cellulase/g fabric)

3: 54 g (=24.9 μg cellulase/g fabric)

Time: 2 hours

Temperature: 55° C.

Abrasion enhancement:

A Wascator FOM 71 wash extractor was used for abrasion enhancement of the denim. The dosage of laccase and mediator was varied in 3 trials.

Denim load: 0.8 kg

Water: 20 l

Buffer: 4.2 g sodium acetate, 3 $H_2O$ 4.0 g succinic acid pH: 5.1

Enzyme: *Trametes villosa* laccase (available from Novo Nordisk A/S)

A: 300 LACU (=5.9 μg laccase/g fabric)

B: 600 LACU (=11.7 μg laccase/g fabric)

C: 900 LACU (=17.6 μg laccase/g fabric)

Enhancing agent10-propionic acid phenothiazine

A: 0.15 g (=0.7 μmole/g fabric)

B: 0.30 g (=1.4 μmole/g fabric)

C: 0.45 g (=2.1 μmole/g fabric)

Time: 20 minutes

Temperature: 60° C.

Evaluation:

As described in Example 2.

Results:

The results are shown in the following table (Table 2):

TABLE 2

| Cellulase dosage (g) | Laccase dosage (LACU) | Dosage of enhancing agent (g) | L* | ΔL* | Visual evaluation of effect |
|---|---|---|---|---|---|
| 8 | — | — | 28.69 | — | No worn look |
| 8 | 300 | 0.15 | 32.47 | 3.78 | Abrasion enhancement (Worn look) |
| 8 | 600 | 0.30 | 34.23 | 5.54 | Abrasion enhancement (Worn look) |
| 8 | 900 | 0.45 | 35.93 | 7.24 | Bleaching (Bleached look) |
| 28 | — | — | 31.58 | — | No worn look |
| 28 | 300 | 0.15 | 33.90 | 2.32 | Abrasion enhancement (Worn look) |
| 28 | 600 | 0.30 | 35.74 | 4.16 | Abrasion enhancement (Worn look) |
| 28 | 900 | 0.45 | 38.50 | 6.92 | Bleaching (Bleached look) |
| 54 | — | — | 32.91 | — | No worn look |
| 54 | 300 | 0.15 | 35.32 | 2.41 | Abrasion enhancement (Worn look) |
| 54 | 600 | 0.30 | 37.90 | 4.99 | Bleaching (Bleached look) |
| 54 | 900 | 0.45 | 40.46 | 7.55 | Bleaching (Bleached look) |

As it can be seen, abrasion enhancement is only obtained if the dosage of laccase and the dosage of enhancing agent is kept below a certain limit (otherwise the result will be a bleached appearance). Also, it is seen that this limit depends on the dosage of cellulase in the abrasion step—the higher the cellulase dosage, the lower the limit is, i.e. following approximate rules:

at 4 μg mono-component cellulase/g fabric abrasion enhancement is obtained at
<15 μg laccase/g fabric and
<2 μmole enhancing agent/g fabric;

at 13 μg mono-component cellulase/g fabric abrasion enhancement is obtained at
<12 μg laccase/g fabric and
<1.5 μmole enhancing agent/g fabric; and at 25 μg mono-component cellulase/g fabric abrasion enhancement is obtained at
<10 μg laccase/g fabric and
<1 μmole enhancing agent/g fabric.

I claim:

1. A process for providing an abraded look with a reduced strength loss in a dyed fabric comprising:

(a) contacting, in an aqueous medium, the dyed fabric with a cellulase in a concentration corresponding to 0.01–250 μg of enzyme protein per g of fabric; and (b) simultaneously or subsequently treating said fabric with a phenol oxidizing enzyme system and an enhancing agent, wherein the enhancing agent is described by formula I:

(I)

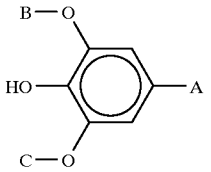

wherein A is —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E is —H, —OH, —R, or —OR, and X and Y and Z are identical or different and selected from —H and —R, wherein R is $C_1$–$C_{16}$ alkyl, which alkyl is saturated or unsaturated, branched or unbranched and optionally substituted with a carboxy, sulfo or amino group; and B and C are the same or different and selected from $C_mH_{2m+1}$ wherein $1 \leqq m \leqq 5$;

or by formula II:

(II)

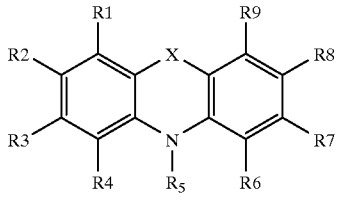

wherein X is (—O—) or (—S—), and the substituent groups $R^1$–$R^9$, which are identical or different, independently are the following radicals: hydrogen, halogen, hydroxy, formyl, carboxy or esters and salts thereof, carbamoyl, sulfo or esters and salts thereof, sulfamoyl, nitro, amino, phenyl, $C_1$–$C_{14}$-alkyl, $C_1$–$C_5$-alkoxy, carbonyl-$C_1$–$C_5$-alkyl, or aryl-$C_1$–$C_5$-alkyl; which carbamoyl, sulfamoyl, and amino groups are unsubstituted or substituted once or twice with a substituent group $R^{10}$; and which phenyl is unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups are saturated or unsaturated, branched or unbranched, and are unsubstituted or substituted with one or more substituent groups $R^{10}$;

wherein $R^{10}$ is the following radicals: halogen, hydroxy, formyl, carboxy or esters and salts thereof, carbamoyl, sulfo or esters and salts thereof, sulfamoyl, nitro, amino, phenyl, aminoalkyl, piperidino, piperazinyl, pyrrolidino, $C_1$–$C_5$-alkyl, or $C_1$–$C_5$-alkoxy; which carbamoyl, sulfamoyl, and amino groups are unsubstituted or substituted once or twice with hydroxy, $C_1$–$C_5$-alkyl, or $C_1$–$C_5$-alkoxy; and which phenyl is substituted with one or more of the following radicals: halogen, hydroxy, amino, formyl, carboxy or esters and salts thereof, carbamoyl, sulfo or esters and salts thereof, or sulfamoyl; and which $C_1$–$C_5$-alkyl, and $C_1$–$C_5$-alkoxy groups are saturated or unsaturated, branched or unbranched, and are substituted once or twice with the following radicals: halogen, hydroxy, amino, formyl, carboxy or esters and salts thereof, carbamoyl, sulfo or esters and salts thereof, or sulfamoyl;

or in which two of the substituent groups $R^1$–$R^9$ together form a group —B—, wherein B is the following the groups: (—$CHR^{10}$—N=N—), $(—CH=CH—)_n$, $(—CH=N—)_n$ or (—N=$CR^{10}$—$NR^{11}$—), in which n represents an integer of from 1 to 3, $R^{10}$ is a substituent group as defined above and $R^{11}$ is defined as $R^{10}$.

2. The process according to claim 1, wherein the fabric is dyed with a vat dye.

3. The process according to claim 2, wherein the vat dye is indigo or thioindigo.

4. The process according to claim 1, wherein the fabric is a cellulosic fabric or a mixture of cellulosic fibres or a mixture of cellulosic fibres and synthetic fibres.

5. The process according to claim 1, wherein the fabric is denim.

6. The process according to claim 5, wherein the fabric is denim dyed with indigo or thioindigo.

7. The process according to claim 1, wherein the cellulase is derived from Humicola, Fusarium, Myceliophthora, or Cephalosporium.

8. The process according to claim 7, wherein the cellulase is derived from *Humicola insolens, Fusarium oxysporum, Myceliophthora thermophila* or *Cephlosporium sp.*

9. The process according to claim 1, wherein the concentration of the cellulase corresponds to 0.5–50 $\mu$g of enzyme protein per g of fabric.

10. The process according to claim 1, wherein the phenol oxidizing enzyme system is a peroxidase and a hydrogen peroxide source.

11. The process according to claim 10, wherein the peroxidase is horseradish peroxidase, soybean peroxidase or a peroxidase enzyme derived from Coprinus, Bacillus, or Myxococcus.

12. The process according to claim 11, wherein the peroxidase is derived from *Coprinus cinereus, Coprinus macrorhizus, Bacillus pumilus* or *Myxococcus virescens.*

13. The process according to claim 10, wherein the hydrogen peroxide source is hydrogen peroxide or a hydrogen peroxide precursor, a hydrogen peroxide generating enzyme system, or a peroxycarboxylic acid or salt thereof.

14. The process according to claim 13, wherein the hydrogen peroxide precursor is perborate or percarbonate, and the hydrogen peroxide generating enzyme system is an oxidase and its substrate.

15. The process according to claim 1, wherein the aqueous medium contains $H_2O_2$ or a precursor for $H_2O_2$ in a concentration corresponding to 0.001–25 mM $H_2O_2$.

16. The process according to claim 1, wherein the phenol oxidizing enzyme system is a laccase or a laccase related enzyme together with oxygen.

17. The process according to claim 16, wherein the laccase is from Trametes, Coprinus, or Myceliophthora.

18. The process according to claim 17, wherein the laccase is derived from *Trametes villosa, Coprinus cinereus*, or *Myceliophthora thermophila.*

19. The process according to claim 1, wherein the concentration of the phenol oxidizing enzyme corresponds to 0.01–250 $\mu$g of enzyme protein per g of fabric.

20. The process according to claim 19, wherein the concentration of the phenol oxidizing enzyme corresponds to 0.5–50 $\mu$g of enzyme protein per g of fabric.

21. The process according to claim 1, wherein the enhancing agent is selected from the group consisting of acetosyringone, syringaldehyde, methylsyringate and syringic acid.

22. The process according to claim 1, wherein the enhancing agent is selected from the group consisting of 10-methylphenothiazine, phenothiazine-10-propionic acid, phenoxazine-10-propionic acid, phenoxazine-10-hydroxyethyl, phenothiazine-10-ethyl-4-carboxy, promazine hydrochloride and phenothiazine-10-ethylalcohol.

23. The process according to claim 1, wherein the enhancing agent is present in a concentration of from 0.05 to 500 $\mu$mole per g fabric.

24. The process according to claim 23, wherein the enhancing agent is present in a concentration of from 0.05 to 100 $\mu$mole per g fabric.

* * * * *